US007168824B2

(12) United States Patent
Schnell

(10) Patent No.: US 7,168,824 B2
(45) Date of Patent: Jan. 30, 2007

(54) UTILITY LIGHT

(75) Inventor: Tim Schnell, Rancho Santa Fe, CA (US)

(73) Assignee: IP Holdings, Inc., Grand Prairie, TX (US)

( * ) Notice: Subject to any disclaimer, the term of this patent is extended or adjusted under 35 U.S.C. 154(b) by 48 days.

(21) Appl. No.: 10/921,762

(22) Filed: Aug. 19, 2004

(65) Prior Publication Data

US 2006/0039148 A1 Feb. 23, 2006

(51) Int. Cl.
*F21V 14/00* (2006.01)

(52) U.S. Cl. ..... 362/256; 362/186; 362/208; 362/256; 362/293; 362/311

(58) Field of Classification Search ..... 362/186, 362/198, 205, 295, 256, 208, 293, 311
See application file for complete search history.

(56) References Cited

U.S. PATENT DOCUMENTS 2,467,954 A * 4/1949 Becker ..... 362/198
4,530,039 A * 7/1985 Shin-Shi ..... 362/158
4,697,228 A * 9/1987 Mui et al. ..... 362/352
5,241,458 A * 8/1993 Abbas ..... 362/110
5,909,952 A * 6/1999 Guthrie et al. ..... 362/184
2003/0016532 A1* 1/2003 Reed ..... 362/184
2005/0024861 A1* 2/2005 Sze-Tai ..... 362/184

* cited by examiner

*Primary Examiner*—Stephen F Husar
*Assistant Examiner*—Meghan K. Dunwiddie
(74) *Attorney, Agent, or Firm*—Schwegman, Lundberg, Woessner & Kluth, P.A.

(57) ABSTRACT

A utility light includes a housing having a storage section, a first light cover having a first color being removably attachable within the storage section, and a second light cover having a second color and being removably attachable within the storage section. The utility light also includes a light coupled to the housing, the light having a mounting section to interchangeably receive one of the first or the second light covers.

10 Claims, 2 Drawing Sheets

UTILITY LIGHT

FIELD

The present invention relates to lights, and more particularly concerns a utility light.

BACKGROUND

Utility lights, such as hand-held flashlights or clip-lights are useful products for directing a beam of light to a specific place needed. The devices typically include a housing holding a power source which is coupled to a light source.

Some users desire to use a different color light for various reasons. For example, gunsmiths feel a blue light, a red light, and a white light each show different characteristics of the condition of a bore of a gun. However, the inconvenience of buying, storing, and finding different colored flashlights can be frustrating.

Therefore, there is a need for a single utility light that can modify its light color characteristics easily, inexpensively, and flexibly.

SUMMARY

A utility light includes a housing having a storage section, a first light cover having a first color being removably attachable within the storage section, and a second light cover having a second color and being removably attachable within the storage section. The utility light also includes a light coupled to the housing, the light having a mounting section to interchangeably receive one of the first or the second light covers.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined or that other embodiments may be utilized and that structural changes may be made without departing from the spirit and scope of the present invention. The following detailed description is, therefore, not to be taken in a limiting sense, and the scope of the present invention is defined by the appended claims and their equivalents.

Figure 1:
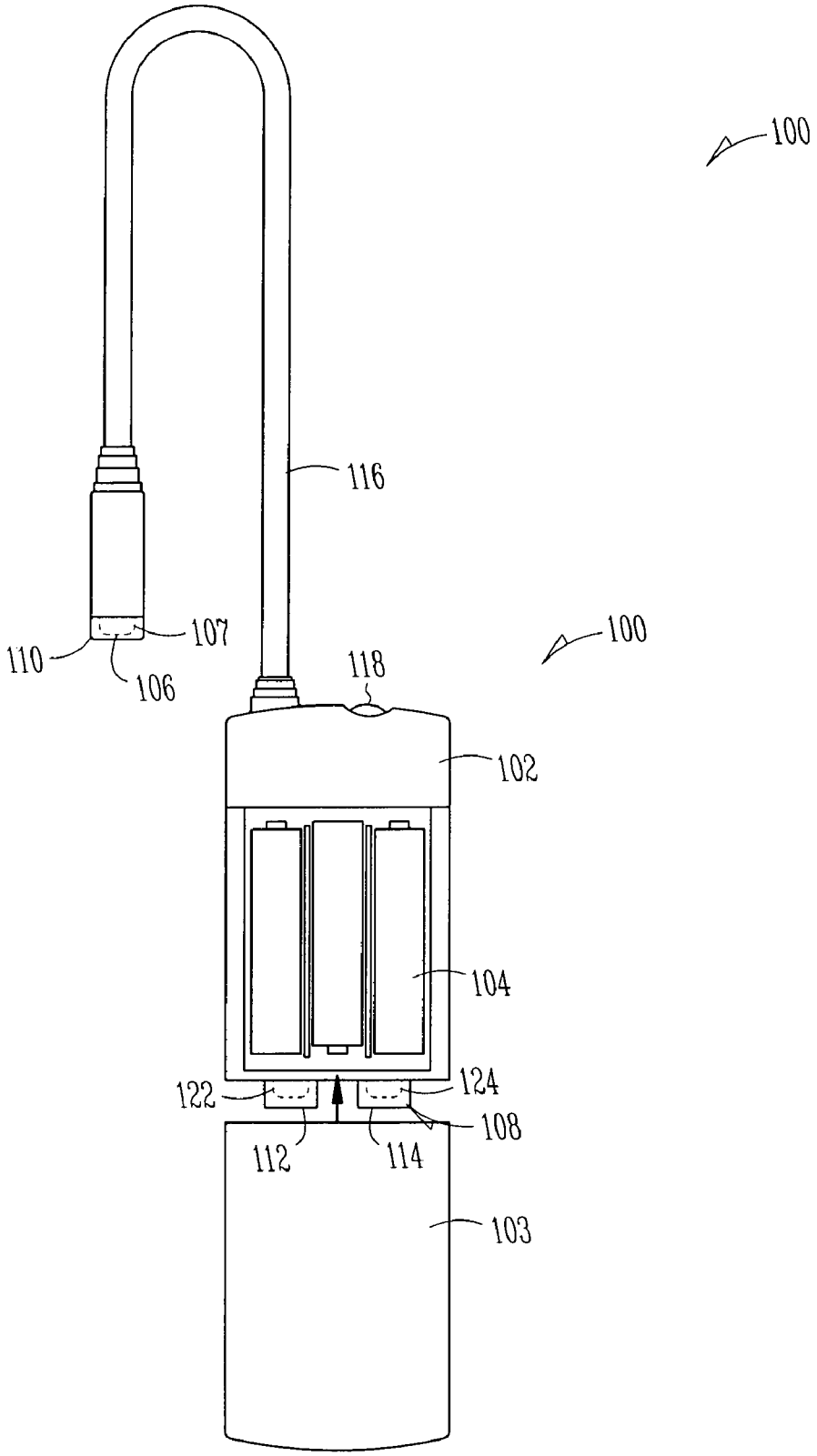
FIG. 1 is a front view of a utility light in accordance with one embodiment.
Figure 2:
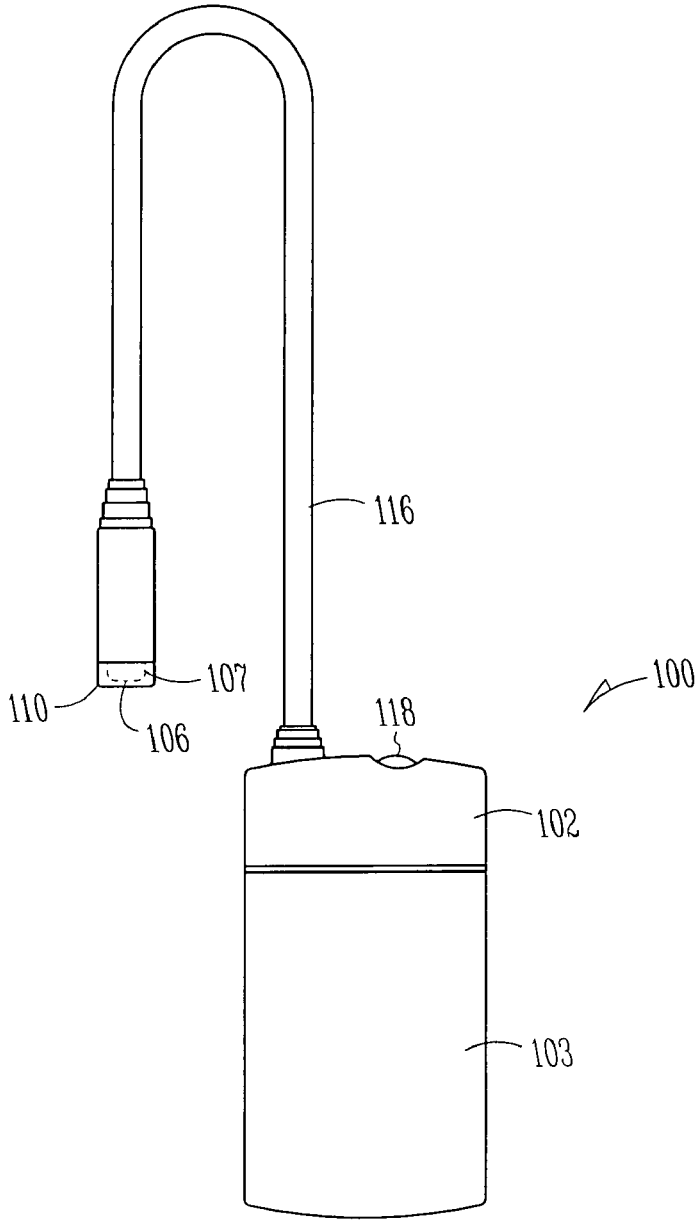
FIG. 2 is a front view of the light of FIG. 1.

FIGS. 1 and 2 show a front view of a utility light 100 according to one embodiment. Utility light 100 is configured to allow a user to modify the light-color characteristics of the light in a manner that does not interfere with its portability or convenience. Utility light 100 includes a housing 102 and a light 106 coupled to the housing by a flexible arm 116.

Housing 102 holds a power source 104, such as three AA or AAA batteries, for example. Some embodiments use other power sources such as button batteries. A housing cover 103 is removable to allow access to the power source. Housing 102 is dimensioned to be held in a hand of a user, or fit within their pocket or clipped to a pocket or belt. For example the housing can have dimensions of about 1.5"× 3"×¾". The housing generally includes rounded or curved sides and can be made of plastic or metal.

Flexible arm 116 conveniently directs the light where needed. Flexible arm 116 includes a first end coupled to housing 102 and a second end coupled to the light 106. The arm 116 can be about four inches long or six inches long, or longer. Flexible arm 116 is structured to be twisted or bent in virtually any orientation and hold its position. In some embodiments, flexible arm 116 can include a rubber flex cable or a metal flex cable, for example. In some embodiments, flexible arm 116 can be omitted and light 106 is connected directly to housing 102.

Light 106 is electrically coupled to power source 104 through wires running through flexible arm 116. A switch 118 controls the power to light 106. In one embodiment, switch 118 can include a dimmer switch, such as a rheostat switch. This allows for a variable amount of power to the light to allow the user to tailor the intensity of the light depending on their need. Light 106 can be a small bulb light or an LED light to project a beam of light.

Utility light 100 includes a light cover mounting section 107 at a distal end of flexible arm 116. Utility light 100 also includes a plurality of light covers 110, 112, and 114 that are interchangeably mountable to light cover mounting section 107. Each light cover 110, 112, 114 includes a transparent or translucent molded plastic of a different color to provide a different color of light being emitted by utility light 100. For example, in one embodiment, light cover 110 is a clear cover, light cover 112 is a blue cover, and light cover 114 is a red cover. Other colors can also be provided as desired. The chosen cover affects the color of light that shines through the cover. Some embodiments use clear or colored glass for the light covers.

Mounting section 107 can include external threads and each of the light covers 110–114 can include corresponding internal threads. This allows the covers to be interchangeably mounted onto the mounting section over light 106. In other embodiments, the mounting section can include internal threads and the light covers have external threads. Optionally, the light covers can be mounted to the mounting section by a frictional fit.

Housing 102 includes a storage section 108 to house and protect the light covers, (112 and 114, in this example), that are not mounted to light cover mounting section 107. Storage section 108 can be a space or cavity within housing 102 for the light covers to be mounted or stored within. In this example, storage section 108 is located in a base end of the housing and light 106 is located on an opposite, top end of the housing.

In one embodiment, storage section 108 can include one or more projections 122, 124 extending from a surface of the housing. In one embodiment, projections 122, 124 include external threads allowing the light covers to be threadably mounted to the projections similar to the threads on mounting section 107. Optionally, the light covers can be frictionally mounted to the projections. In one example, the projections 122, 124 are small threaded or unthreaded studs having a height of about ⅛" and a diameter of about ¼". Again, the threads and inner diameters of all the light covers 110–114 are the same so that they can be mounted interchangeably on the light cover mounting section 107 and to storage section 108. Accordingly, any of the light covers 110–114 are easily removed from storage section 108 and mounted to mounting section 107, and vice versa. Housing cover 103 also covers over and encloses storage section 108 when the cover 103 is attached to the housing. In some embodiments, the covers can be stored outside the storage compartment. For example, projections can be provided on cover 103 to mount the light covers to the cover itself.

Figure 3:
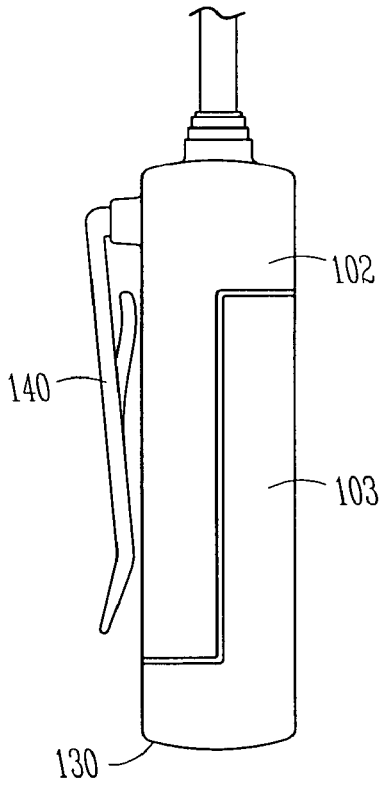
FIG. 3 is a side view of the light of FIG. 1.

FIGS. 2 and 3 show the housing cover 103 closed over and covering batteries and light covers 112 and 114. From a side view (FIG. 3), housing cover 103 includes an L-shaped profile with a bottom 130 of the L-portion enclosing over the light-cover storage section.

Utility light 100 can also include a clip 140 attached to housing 102. Clip 140 can be used to clip the utility light to a shirt pocket, a belt, a hat, or other item.

In use, a user selects which light color is appropriate. For example, the user can choose between a clear cover, a blue cover, and a red cover. The appropriate cover is removed from storage section 108 and mounted onto light cover mounting section 107 over the light. The removed light cover can then be placed into the storage section 108. The housing 102 can be fit within a shirt pocket or clipped onto a pocket or belt. The flexible arm 116 is twisted to an appropriate orientation and the light is switched on. The dimmer switch allows the user to change the intensity of the light for different uses by allowing for a continually changing intensity of the light.

One use of a utility light described above is for inspecting a bore of a gun. For example, the user chooses a desired color for the light cover and mounts the cover over the light. The light is emitted down the barrel of the gun and the user looks with a scope down the other end to inspect the barrel. The clear light is used to provide normal, clear illumination. The red light does not impair night vision and is useful in low light situations. The blue light helps highlight small particles in gun barrels, and also helps illuminate certain fishing lines with fluorescent filament, for example.

In other embodiments, the light can be used for various tasks. For example, the light and the different covers can be used for fishing tasks, fly-tying, model-making, as a book-light, a utility light, or for other needs.

Again, the present utility light allows a user to modify the light-color characteristics of a light inexpensively and in a manner that does not interfere with the light's portability or convenience. In this way, a user of the utility light can change to an alternative light color in a simple and quick manner by interchanging the light covers.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. An apparatus comprising:

a housing holding a power source;

a light coupled to the power source;

a mounting section for mounting a light cover over the light; and a plurality of light covers, each light cover having a different color and being interchangeably mountable to the light cover mounting section of the light, the housing includes a storage section and each of the plurality of light covers is interchangeably storable in the storage section when not mounted to the mounting section, the storage section including a plurality of projections dimensioned to mount the light covers interchangeably thereon.

2. The apparatus of claim 1, wherein the housing is dimensioned to be held in a hand of a user.

3. The apparatus of claim 1, wherein the plurality of light covers includes a clear light cover, a red light cover, and a blue light cover.

4. The apparatus of claim 1, including a dimmer switch coupled between the light and the power source.

5. The apparatus of claim 1, including a flexible arm having a first end coupled to the housing and a second end coupled to the light.

6. The apparatus of claim 1, wherein the mounting section includes threads configured to engage threads on each of the first and second light covers.

7. The apparatus of claim 1, wherein the storage section is located in a base end of the housing and the light is located on an opposite, top end of the housing.

8. The apparatus of claim 1, wherein the mounting section includes threads configured to engage threads on each of the first and second plurality of light covers.

9. The apparatus of claim 5, wherein the flexible arm is at least 4 inches long.

10. The apparatus of claim 5, wherein the flexible arm is at least 6 inches long.

* * * * *

UNITED STATES PATENT AND TRADEMARK OFFICE

CERTIFICATE OF CORRECTION

PATENT NO. : 7,168,824 B2
APPLICATION NO. : 10/921762
DATED : January 30, 2007
INVENTOR(S) : Schnell It is certified that error appears in the above-identified patent and that said Letters Patent is hereby corrected as shown below:

In column 4, line 40, in Claim 8, delete “first and second” before “plurality”.

Signed and Sealed this

Seventeenth Day of April, 2007

JON W. DUDAS
*Director of the United States Patent and Trademark Office*